United States Patent [19]

Watry

[11] 4,147,009

[45] Apr. 3, 1979

[54] PRECAST PANEL BUILDING CONSTRUCTION

[76] Inventor: C. Nicholas Watry, 955 Cambridge Rd., Redwood City, Calif. 94061

[21] Appl. No.: 773,853

[22] Filed: Mar. 3, 1977

Related U.S. Application Data

[63] Continuation-in-part of Ser. No. 637,580, Dec. 4, 1975, abandoned.

[51] Int. Cl.[2] ..... E04B 5/19

[52] U.S. Cl. ..... 52/744; 52/228; 52/236.8; 52/259; 52/747; 264/35; 264/228

[58] Field of Search ..... 264/35, 228, DIG. 57; 52/251, 258, 259, 747, 745, 223 R, 227, 228, 236.8, 744

[56] References Cited

U.S. PATENT DOCUMENTS

| | | | |
|---|---|---|---|
| 2,295,216 | 9/1942 | Joy | 52/744 X |
| 2,815,656 | 12/1957 | Klein | 52/258 X |
| 3,300,943 | 1/1967 | Owens | 264/35 X |
| 3,341,639 | 9/1967 | Naillon | 52/744 X |
| 3,614,049 | 10/1971 | Keyston | 264/35 X |
| 3,691,708 | 9/1972 | Firnkas | 52/259 X |
| 3,785,608 | 1/1974 | Heinzman | 264/DIG. 57 X |
| 3,952,474 | 4/1976 | Rice | 264/228 X |
| 4,065,907 | 1/1978 | Rice | 52/227 X |

*Primary Examiner*—Thomas P. Pavelko
*Attorney, Agent, or Firm*—C. Michael Zimmerman

[57] ABSTRACT

A method is described for constructing a concrete building from precast concrete wall and floor panels. Each floor construction has a plurality of spaced-apart dowels which project upwardly above its surface along the proposed joint between the floor and a proposed wall, and each of the wall panels includes along its length vertical voids which extend for its full height at a spacing from one another generally the same as the spacing between the dowels projecting upward from the floor construction. The load bearing walls of the building are formed by erecting wall panels for the same vertically at the proposed joint with the dowels extending into the wall panel voids. Reinforcing rods are introduced into the voids to overlap the ones projecting upward from the floor, and the voids are filled with mortar to tie each of such wall panels to the floor below. A mortar junction resistant to horizontal shear forces is formed between the floor construction and the wall panel at the time the panel is otherwise interlocked to the floor to resist vertical stress forces. The floor construction is formed by supporting floor panels horizontally adjacent one another spanning the space between a pair of parallel, load bearing wall panels. Post-tensioning cables are positioned between and threaded through such floor panels, and recessed keyways are provided at the joints between adjacent panels. Mortar placed in such joints interlocks the adjacent panels to resist horizontal shear stresses, and the cables are post-tensioned to otherwise support and tie the floor panels together to resist vertical loading and seismic forces.

7 Claims, 12 Drawing Figures

PRECAST PANEL BUILDING CONSTRUCTION

CROSS-REFERENCE TO RELATED APPLICATION

This application is a continuation-in-part of my copending patent application Ser. No. 637,580, filed Dec. 4, 1975 for PRECAST WALL BUILDING CONSTRUCTION, now abandoned.

BACKGROUND OF THE INVENTION

The present invention relates to precast building construction and, more particularly, to a relatively simple and inexpensive method of forming a concrete building with precast wall and floor panels which results in a unitized building capable of effectively resisting vertical and horizontal loads.

Multi-story concrete buildings are generally formed by casting in place both the floors and the supporting walls. That is, a floor slab providing the floor for each story is formed or raised into place, and then the concrete walls for such story are poured directly at the location at which they will appear in the building. This method of construction has been followed to assure that the physical connection between the walls and floors will be of sufficient structural strength to resist the vertical and horizontal forces to which it may be subjected, such as by an earthquake. However, such a method of construction requires a significant labor force and a time-consuming procedure. The result is that this type of concrete building construction is relatively expensive.

In order to circumvent the expense involved in such a construction, those in the art have turned in many instances to other types of construction. One type is the so-called "tilt-up" method of construction. In such a method, the walls are formed in sections prior to the time the building is to be erected, and then are tilted vertically into the location desired for them. Generally, such an erected wall is tied to the building floor slab by either forming a concrete beam encompassing its lower edge or by having the floor slab poured around the bottom of the wall after it is erected. The difficulty with tilt-up construction, though, is that its use is generally limited to one-story buildings since the tilt-up walls typically are perimeter walls. Moreover, mechanical connectors of one sort or another are generally required to connect adjacent wall sections together and to structurally connect such walls to a later applied roof. Such connectors are often complicated and require an inordinate amount of installation time.

Another type of construction relies on factory built panels to construct the walls and/or floors of a concrete building. Factory built concrete components are becoming increasingly expensive, however, primarily due to fuel and transportation costs. Moreover, with most of such systems an additional concrete slab must be poured on top of the precast slabs at the site for each of the floors to tie the precast components together. Thus, this method does not significantly circumvent the labor force and long procedure required in poured-in-place construction. Intensive mechanical connections or welding are also often required in such methods to tie the concrete components together.

One other approach which has been proposed and used in the past to construct multi-story buildings is one in which precast wall panels are provided with voids and then interlocked to a floor slab by having reinforcing dowels or rods or the like extending upward from the floor slab project into such voids. Additional reinforcing rods are then introduced into the voids to overlap the ones projecting upward from the floor, and the voids are filled with grout. While this approach to multi-story construction provides sufficient structural integrity to resist any vertical loads to which the connection between the wall panels and floor slabs are subjected, it does not provide the resistance against horizontal shear which is necessary in active seismic areas. And again, the floor slabs are poured in place with the resulting expense and time consuming procedure associated therewith.

SUMMARY OF THE INVENTION

The present invention provides a method of forming a concrete building with precast wall and floor panels which is amenable to multi-story construction and yet is quite structurally sound. In its basic aspects, the method of the invention includes the steps of forming a base supporting structure, e.g., a horizontal floor slab or foundation; providing a preformed wall panel; placing the wall panel vertically along a proposed joint between the base structure and a proposed wall; and then interlocking the wall panel and the base structure at the joint to transmit therebetween any vertical load to which either is subjected.

Most desirably, vertical load is resisted by interlocking the wall panel and base structure by the wall void-dowel manner discussed earlier to further obviate the necessity of mechanical connectors. To this end, the grade slab or other base structure is preferably formed with a plurality of spaced-apart dowels projecting thereabove centrally along the proposed joint. The preformed wall panel is correspondingly provided with voids which extend vertically therethrough at spacings which match the spacings between the dowels. The wall panel is then interlocked to the base structure by placing the wall panel along the proposed joint with the dowels projecting into associated voids within the wall; inserting a reinforcing bar into each of the wall voids to a location at which the bar will overlap the dowel projecting into such void; and thereafter forcing mortar into the voids to tie each of the reinforcing bars to its associated dowel.

As another salient feature of the instant invention, it includes a method of forming floor slabs out of precast panels which assures that the resulting floor construction has adequate load bearing and horizontal shear transference capabilities. In its basic aspects, such method includes the steps of erecting two load bearing walls generally parallel to, and spaced apart from, one another, and then supporting at least two floor panels on the two walls horizontally adjacent one another spanning the space between such walls. A post tensioning cable is draped along the joint between the adjacent floor panels with those portions of the cable over the load bearing walls positioned vertically above a portion of the cable positioned over the space between the walls. The joint between the adjacent floor panels and over the wall is then filled with mortar and after such mortar sets, the cables are post-tensioned to transmit the vertical load of such floor panels to the vertical walls. Most desirably, the floor panels are constructed with transverse voids. through which a post-tensioning cable can be threaded across the joint between adjacent panels. Tension is applied to such cable after the joint-filling mortar sets in order to compress the joint for temperature reinforcement. The opposed edges of adjacent floor panels are also provided with recessed keyways which interlock adjacent floor panels upon the mortar setting to transmit therebetween any horizontal shear forces.

When the above floor slab mode of construction is combined with the wall panel construction described previously, the result is a structurally strong concrete building made almost entirely from modules. Most desirably, both the wall and floor panels are precast horizontally at the location at which the concrete building is to be erected. Thus, the advantages of mass production responsible for the use of factory made panels in many instances is transferred by the invention directly to the building site.

The invention includes other features and advantages which will become apparent from the following more detailed description of a preferred embodiment of the method.

BRIEF DESCRIPTION OF THE DRAWING

With reference to the accompanying three sheets of drawing.

DETAILED DESCRIPTION OF A PREFERRED EMBODIMENT

The method of the invention provides construction with on-site precast wall and floor panels of a concrete building of sufficient structural integrity to withstand seismic loading. In this regard, only the base structure, i.e., a foundation or grade slab, is cast monolithically in place. The remainder of the load bearing floors and walls of the building can be formed from precast panels. Such panels are structurally tied together in a manner which results in the building being capable of resisting vertical and seismic loads or forces, but which does not require the use of expensive and time consuming mechanical connectors in order to obtain the required structural connection between such wall and floor panels.

The base supporting structure of a building erected in accordance with the invention can be formed in a generally conventional manner. For example, when such base supporting structure is a grade slab, it is formed by pouring hydraulic cement into a form which defines a configuration desired for the periphery of the slab. Such slab should be reinforced concrete and, to this end, the form for it will support that reinforcing steel which is to be embedded therewithin. The slab is preferably post-tensioned for enhanced structural strength. Of course, the usual floor plumbing, electrical conduits, etc., are also embedded within the slab.

The load bearing vertical walls for the building are provided along each major axis in order to support vertical loads and resist seismic forces. As mentioned previously, such walls are formed by wall panels which are interlocked and joined to the base supporting structure and upper floor panels in a manner which is quite simple and yet provides the structural strength required to resist seismic events. In this connection, as used herein and in the claims the term "floor" panels is meant to include panels which provide a ceiling or roof slab whether or not such slab also provides a floor for another story of the building. Also, the term "floor construction" is meant to encompass a ceiling or roof construction.

Figure 1:
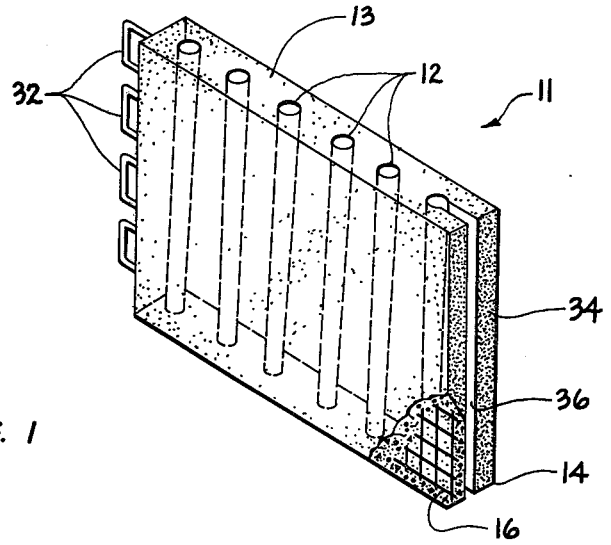
FIG. 1 is a partially broken away isometric view of a preformed concrete wall panel which is especially adapted for use in a preferred embodiment of the method of the invention.

FIG. 1 illustrates a wall panel, generally referred to by the reference numeral 11, which is designed to facilitate a preferred mode of providing the desired interlocking. To this end, such panel has a plurality of spaced apart, parallel voids 12 extending vertically therethrough from its upper edge 13 to its bottom edge 14. While the precise distance between the voids is not critical, it is preferred that these voids be no more than 18 inches apart. Most preferably, the center axes for the voids in a six inch thick wall are about 18 inches apart and the voids have a diameter of three inches at the upper edge 13 of the panel. For reasons which will be discussed hereinafter each of the voids is tapered inwardly towards its lower end to a diameter of, for example, two and one-half inches.

The provision of voids in the wall panel 11 not only provides interlocking structure for securing the panel to the floor structure as will be discussed, but it also reduces the weight of such wall panel and facilitates its manipulation. As illustrated where panel 11 is broken away, the wall panels also preferably include reinforcing sheets 16 of welded wire fabric embedded within its concrete adjacent each of its side faces.

Figure 2:
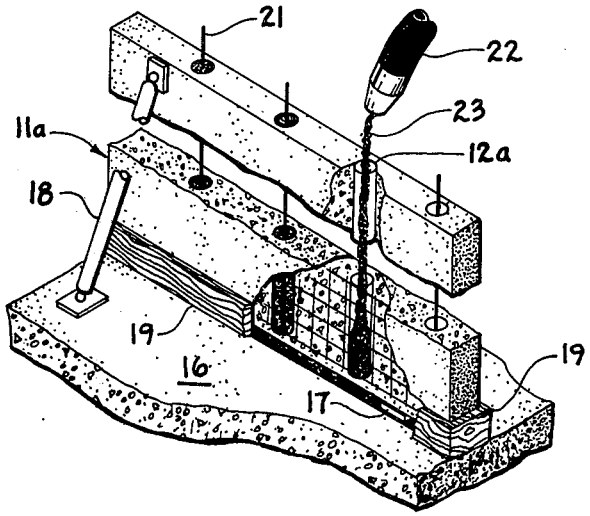
FIG. 2 is a partial and broken-away isometric view illustrating steps in the preferred embodiment of the method of the invention.

A plurality of wall panels are generally secured to a base structure to provide the load bearing vertical walls. FIG. 2 illustrates the manner in which the voids 12 in such panel are employed to interlock a wall panel to a grade floor slab. In this connection, the grade slab is formed with a plurality of spaced apart dowels projecting thereabove centrally along a proposed joint between such slab and a proposed wall. Such dowels are typically formed of reinforcing bar material having a diameter of, for example, three-quarters inch, and project above the floor slab about one and one-half feet. The spacing between adjacent dowels is generally the same as the spacing between the voids in the wall panels. The ends of the dowels embedded within the grade slab are most desirably tied to the reinforcing steel of the slab. As will be discussed in more detail hereinafter, when the horizontal floor structure is supported above the ground by wall panels, reinforcing bars extend from the lower wall panels through the floor structure to provide the dowels for the wall panels of the higher story.

To erect the walls for the building, each wall panel is individually placed with a crane or the like vertically along its proposed joint with the horizontal grade slab, with the dowels at such location registering with, and projecting into, the panel wall voids. Each of the wall panels is not only interlocked to the floor to transmit therebetween any vertical load to which either is subjected, but a mortar junction is also formed between the floor and each of the wall panels along substantially the wall panel's full length. Such a mortar junction resists shear at the wall base structure joint by transmitting between the base structure and the wall panel any force tending to cause such shear. The mortar junction also seals the wall panel to the grade slab.

The mortar junction is formed simultaneously with the interlocking of the wall panel to the grade slab. FIG. 2 illustrates a wall panel 11*a* being secured to a grade slab 16 in a preferred manner. As shown in such figure, when the panel 11*a* is placed along the proposed joint, it is spaced from the grade slab by shims 17 or the like for a distance equal to the thickness of the desired mortar junction between the panel and floor. The wall 11*a* is otherwise temporarily braced, such as by a bar or jack 18, to maintain it in position and appropriately oriented until such time as it is to be structurally secured. Then a form for the mortar junction, e.g., the boards 19, are supported about the spacing between the panel and slab to define the peripheral edges of the mortar junction.

Figure 4:
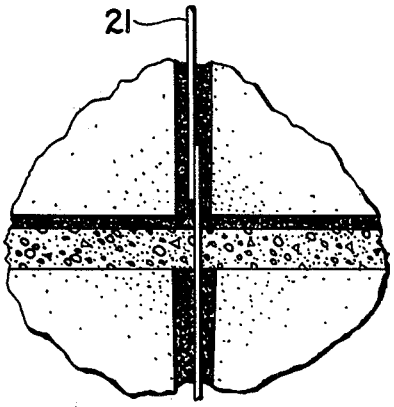
FIG. 4 is an enlarged view taken at the circle indicated by 4—4 in FIG. 3, illustrating in more detail a mortar junction between a concrete wall panel and a concrete floor slab formed in accordance with a method of the invention.

A reinforcing rod or bar 21 is then inserted into each of the voids through its upper end to a location at which the bar will overlap the dowel also projecting into such void. This relationship of the reinforcing bars with the dowels is best illustrated in FIG. 4. After the reinforcing rods are so inserted into the voids 12, a mortar having a grout consistency, such as the expansive cement and sand grout sold under the trademark "Chemcomp" by Kaiser Cement and Gypsum Co., Oakland, California, is forced into each of the voids with sufficient pressure to cause such mortar to not only fill the voids but also to fill the junction space between the wall panel and the grade slab. In this regard, a pressure nozzle 22 is represented in FIG. 2 injecting a stream 23 of mortar into a void 12. As illustrated, such mortar will flow out of the lower end of such void into the junction space between the grade slab and wall panel. A groove 24 is provided along the bottom edge of the panel to facilitate lateral flow between the voids. The voids 12 of the panel are filled in succession in this manner from one end of the wall panel to the other. The result is that the mortar junction will be formed incrementally along the length of the wall panel as the voids are filled.

When the mortar within each void cures, it will tie the dowel projecting upwardly into such void to both the wall panel directly and also to the reinforcing bar which extends upward therefrom. The provision of the reinforcing bar 21 enhances the connection between the dowel and the wall panel. Also, as will become apparent hereinafter, it will act as means for transmitting any vertical load from one floor of a building to the other.

As previously mentioned, each of the voids 12 is tapered inwardly toward its lower end. The tapered wall of the void will coact with the reinforcing rod, dowel and mortar within the void to enhance the resistance of the connection between the floor slab and wall panel to vertical stress.

Figure 3:
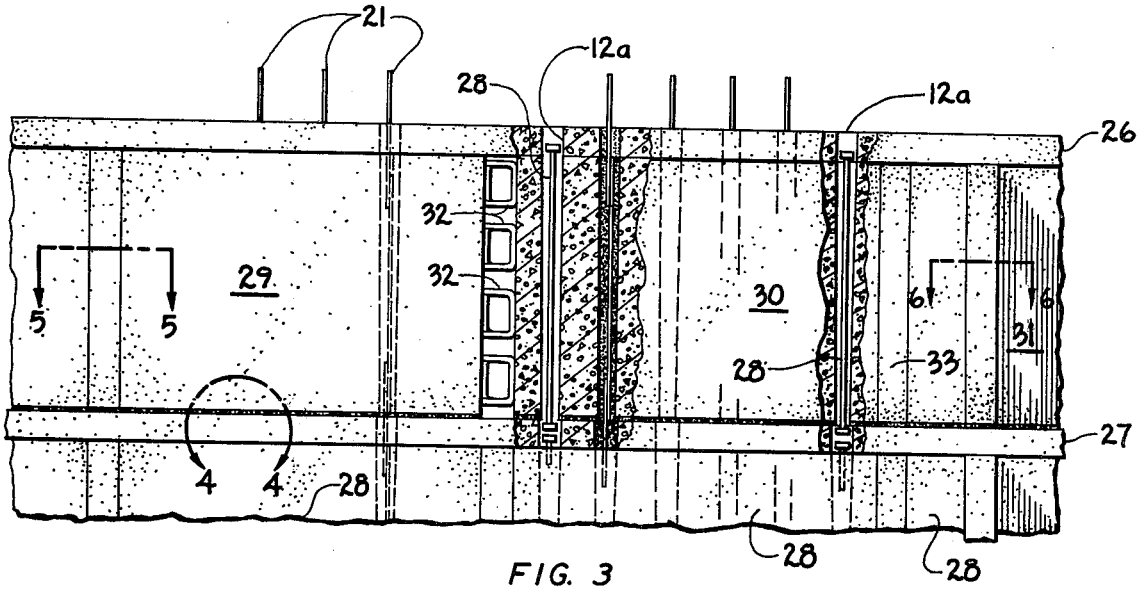
FIG. 3 is a broken-away elevation view of a portion of a building structure formed by a method of the invention.

FIG. 3 illustrates a section of a multi-story building construction having a plurality of wall panels secured by the method of the invention between a pair of upper and lower floor structures 26 and 27, respectively. As schematically represented in such figure, the reinforcing bars or rods 21 of the panel 28 providing the walls of the story below the floor structure 27 extend upwardly through such structure to act as the dowels for the panels 29, 30 and 31 directly thereabove. FIG. 4 provides an enlarged illustration of this feature. This construction results not only in the desired securance of each of the respective wall panels to the floor structure but also structurally ties the wall panels of adjacent stories together.

Each of the wall panels is also structurally connected between the floor structures so as to resist seismic or other forces which will tend to rock the same from end to end. That is, as is illustrated for the panel 30 in FIG. 3, the voids 12*a* adjacent the side edges of the wall panel are provided with tensioning means which extend between the floor slabs 26 and 27, rather than with the overlapping dowel-reinforcing bar connection. Such tensioning means takes the form of a post-tensioning rod 28 in each of such voids, which is maintained in tension between the structures 26 and 27. In the fabrication of the building, the rods 28 are embedded in the lower floor and extend through the end voids of the panels. When the upper floor is formed, a cavity is provided to enable access to the upper end of the tensioning rod to allow such rod to be post-tensioned. The cavity can then be suitably filled with mortar to the floor level. Such an end tensioning arrangement is particularly advantageous in those areas in which strong, rolling seismic forces might occur.

Figure 5:
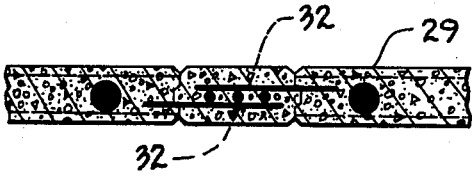
FIG. 5 is an enlarged sectional view of a portion of the building structure of FIG. 3 as indicated by the lines 5—5, illustrating a manner in which adjacent wall panels can be structurally tied together.

FIG. 3 also illustrates the manner in which adjoining wall panels are securable together. The panels 29 and 30 are in spaced apart, side edge-to-side edge alignment with one another to provide a continuous single wall. As shown, each of the panels is provided with reinforcing steel protruding from its side edge which is opposed to a side edge of the adjacent panel. Such reinforcing steel is preferably in the form of a plurality of rectangularly bent reinforcing bars 32, such as is illustrated isometrically in FIG. 1. The reinforcing bars protruding from the adjacent side edges of the panels overlap one another. The panels are then secured together to form the desired continuous wall by forming a concrete column within the space between the opposed edges of the adjacent panels, encompassing and tying together the bars protruding from the panels. While for illustration's sake the concrete column forming the joint between the panels 29 and 31 is omitted, FIG. 5 is a sectional view of the joint between the panel 29 and the panel adjoining its left hand edge, which joint is shown completed. The manner in which the column encompasses and ties together the reinforcing steel and, hence, the adjacent panels is best seen in such figure.

Figure 6:
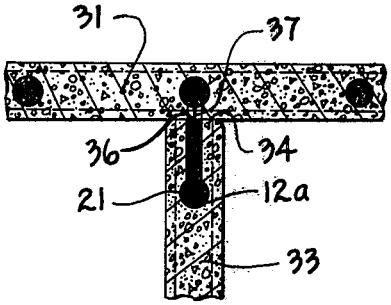
FIG. 6 is another enlarged sectional view of a portion of FIG. 3 as indicated by the lines 6—6, illustrating the manner in which a wall panel abutting perpendicularly to a wall can be structurally secured thereto.

FIGS. 3 and 6 illustrate a preferred manner in which a wall panel which perpendicularly abuts against the face of another wall panel can be secured thereto. That is, wall panel 33 is shown in such figures abutting and secured to the front side face of panel 31. To facilitate securance between the panels, the end 34 of the panel 33 which is abutted against the face of panel 31 has a channel 36 which extends vertically along its length and communicates with the end void 12*a* of such panel. The channel 36 facilitates interlocking the abutting wall panel with reinforcing steel to a reinforcing bar in the wall against which it abuts. That is, abutting panel 33 is positioned adjacent a void in the wall 31 which is abutted, and access holes, one of which is illustrated at 37 in FIG. 6, are drilled or otherwise provided on, for example, 18-inch centers, through the side face of the abutted wall to such void. Reinforcing wire tied to the bar 21 in the void 12*a* of the abutting panel 33 is passed through the holes and secured to the reinforcing bar 21 in the void of the panel 31 prior to the time either of such voids are filled with grout. Once such voids and the channel 36 have been filled with grout, a structurally strong securance between the walls is achieved.

Figure 7:
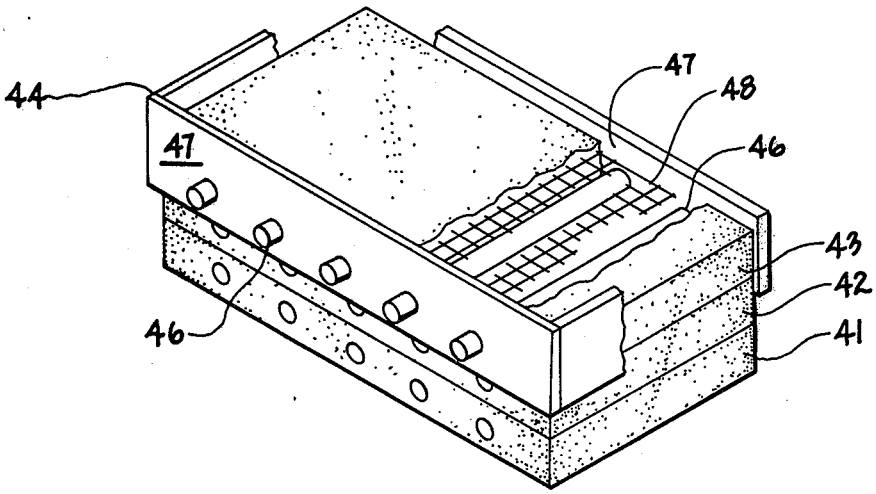
FIG. 7 is an isometric view illustrating the manner in which a plurality of wall panels usable in the invention can be formed in stacked relationship at the site of a building construction.

As another feature of the invention, it includes a method of forming a plurality of wall panels 21 directly at the site at which the concrete building is being erected. FIG. 7 illustrates the simple manner in which this is accomplished. That is, the panels are formed horizontally at the site in a stacked relationship, i.e., a previous panel is used as the bottom of the form for subsequent panels. This results in a minimum of ground space being required for such casting. Since ground space is often at a premium at a construction site, it is this cast stacking which often enables on-site fabrication of the panels in situations in which it would not otherwise be possible.

In more detail with reference to FIG. 7, three panels 41-43 are shown horizontally in stacked relationship on top of one another. The form for panel 43 is shown prior to the same being removed, and the panel is otherwise broken-away to illustrate details in the manner in which it is constructed. The panel is formed by building a hydraulic cement form 44 defining the peripheral edges desired for the wall panel and then placing mandrels 46 extending generally parallel to one another between the longitudinal walls 47 of the form defining the upper and lower edges for the panel. Such mandrels are supported along the central plane of the panel by the opposed ends thereof simply extending through suitable apertures in the form walls 47. Welded wire fabric sheets 48 are supported with the form at locations inwardly adjacent the desired locations for the outer side faces of the finished panel, and hydraulic cement is poured into the form to provide the panel with both the reinforcing sheets and the mandrels embedded therein.

After a poured panel has set a self-supporting state, the mandrels therein are removed to provide the completed panel with the desired parallel voids. In this connection, the cross-section of each of the mandrels most desirably tapers in size along its length between the locations it passes through the form walls 47 from, for example, a three inch outer diameter to a two and one-half inch outer diameter. This will provide the voids with the desired wall taper discussed previously. It also facilitates extraction of such mandrels. Because of the taper the mandrels can simply be extracted through the end of the void provided thereby which is the larger in cross-sectional area. While the mandrels could be of any suitable material, it is preferred that they be formed of fiberglass. The adhesion between fiberglass and cured concrete is low, with the result that fiberglass mandrels are easily extracted to provide the voids.

After the panel has been formed, another panel of the same size can be simply formed by supporting the form 44 above the previously cured panel so that such previous panel provides the bottom of the form. Of course, the face of the panel providing the form should be covered with a material, such as a bond breaker coating, which will enable separation of the finished panels.

Figure 8:
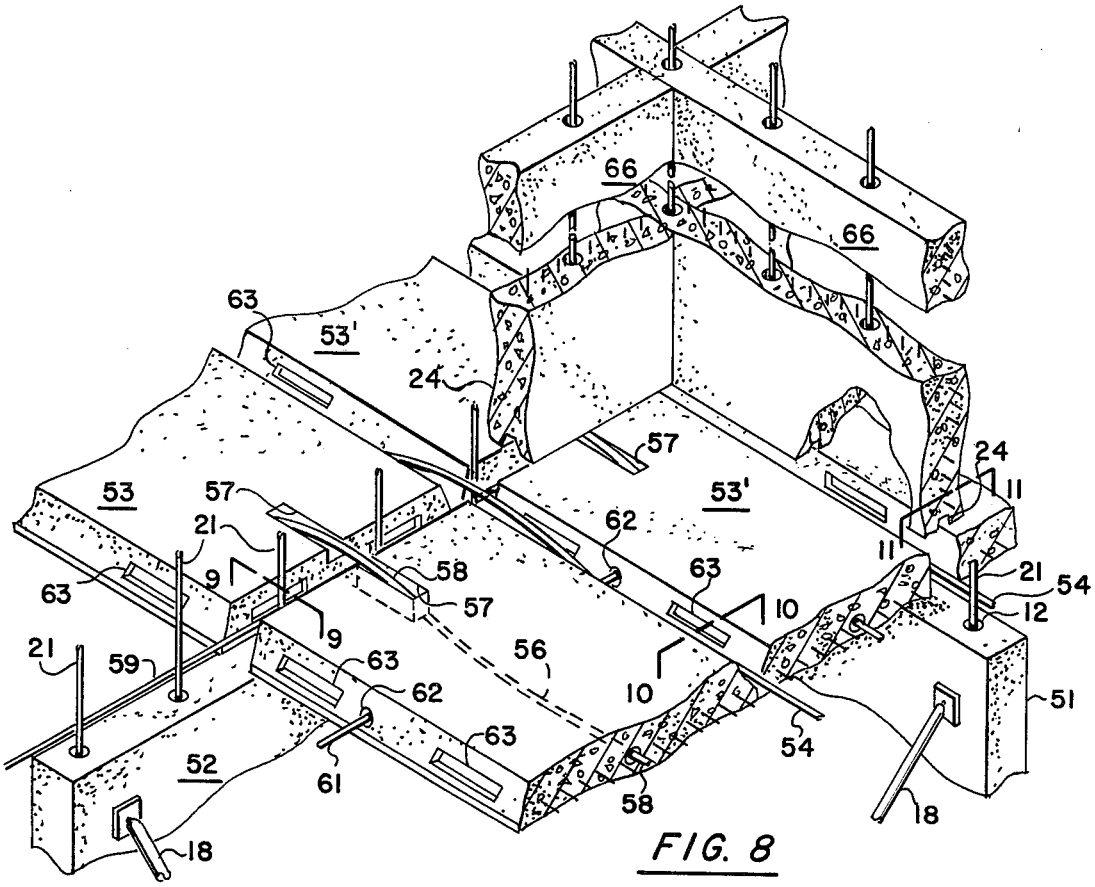
FIG. 8 is a partially broken-away isometric view of a portion of a concrete building during construction thereof in accordance with a preferred embodiment of the method of the invention, illustrating wall and floor panels for an upper story in their assembled positions.

Most desirably, the previously described method of forming the load bearing walls of a concrete building is combined with a method of also forming floor slabs in a modular fashion. FIGS. 8 through 12 illustrate a particularly salient arrangement for such a construction. With reference to FIG. 8, perpendicularly related wall panels 51 and 52 which are to be secured to a grade slab (not shown) are illustrated after being erected and temporarily supported in position by jacks 18, but prior to the time at which mortar is fed into the voids 12. Reinforcing rods 21, however, are inserted into each of the voids to overlap the dowels projecting upwardly from the grade slab in the manner previously described.

The floor slab for the upper story is formed by a plurality of similar floor panels 53 positioned horizontally adjacent one another. Each of such floor panels is supported on the upper edge of a pair of parallel, spaced load bearing walls of the lower story, one of which is represented by the wall panel 52. The other load bearing wall on which the opposite ends of the panels 53 rest is not illustrated for the sake of clarity.

The actual number of floor panels which are supported adjacent one another will depend, of course, on the extent of the desired floor slab. It is desirable from the modular viewpoint that the width of the floor panels be an integral division of the length of the wall panels so that a given number of floor slabs will be supported in flush relationship to the top surface of an individual wall panel. For example, in the construction illustrated in FIG. 8, it is contemplated that the wall panel 52 have a length of about 24 feet so as to support three floor panels, two of which are shown, having a width of eight feet. The length of the floor panels 53 would vary as desired to span the spacing between the parallel load bearing walls which support the same.

Figure 9:
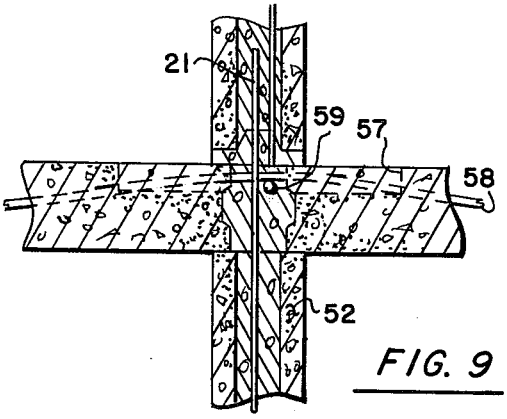
FIG. 9 is a sectional view of a completed wall and floor panel joint at a load bearing location, such as the location indicated generally by the lines 9—9 in FIG. 8.

After the panels 53 are positioned in place, cables for post-tensioning the finished floor construction are laid and threaded into position. In this connection, one set of such cables are placed along the adjacent floor panels transverse to the load bearing walls. More particularly, post-tensioning cables 54 are draped along the joint between adjacent floor panels, such as between floor panels 53 and 53', in the so-called parabolic manner. That is, each of such cables is draped in its associated joint with that portion thereof extending over load bearing walls, positioned vertically above that portion of the cable positioned over the space between the walls. FIG. 9 illustrates the path taken by the cable 58 over the load bearing wall 52.

In those instances in which the floor panels 53 are relatively wide, post-tensioning cables are also threaded through voids which are parallel to the cables 54. To this end, each of such panels is formed with a void 56 extending in such parallel direction. The opposite ends of each panel are provided with blockouts 57 at their upper surface. Such blockouts of each of the panels are communicated with one another by the voids 56 to enable a post-tensioning cable 58 to be threaded between longitudinally adjacent panels with a portion thereof in the aligned blockout accessible for the threading operation.

Post-tensioning cables 59 and 61 are also added to the assembly in a direction running transverse to the cables 54 and 58, i.e., across the joint between the panels 53 and 53'. Cable 59 is placed along the upper end of the panel 52 at a height generally one-half the thickness of the panels 53. The cable 61 is threaded through linear voids 62 which extend through each of the floor panels 53 between its side edges. As can best be seen by comparing FIGS. 9 and 10, the cable 59 between longitudinally adjacent panels is positioned underneath the cables 54 and 58, whereas the cables 61 are positioned above such cables 54 and 58.

Figure 10:
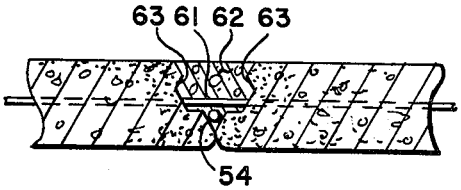
FIG. 10 is an enlarged partial sectional view of a joint between two adjacent floor panels at a location indicated generally in FIG. 8 by the lines 10—10.
Figure 11:
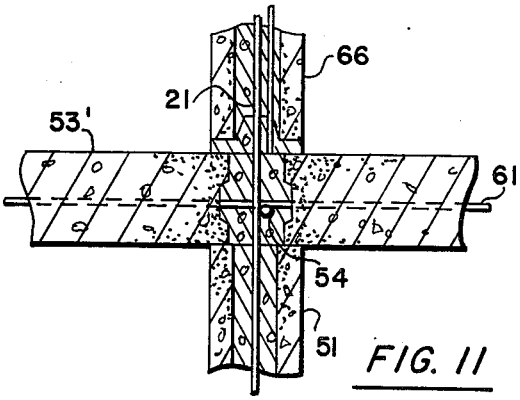
FIG. 11 is an enlarged partial sectional view of a joint between wall and floor panels of a completed construction taken generally on a plane indicated in FIG. 8 by the lines 11—11.

After all of the post-tensioning cables are draped within joints and threaded through panels as discussed above, the floor panels 53 are interlocked together with mortar at the same time mortar is inserted through the voids 12 to fuse the walls 51 and 52 to the grade slab. In this connection, it is to be noted that as illustrated in FIG. 10, the opposed edges of adjacent floor panels which do not have a wall at the joint are inclined outwardly toward the lower panel surface so that the adjacent panels will form a channel 62 which will support the mortar. Also, as another salient feature of the method, the opposed edges of the floor panels are provided with recessed keyways 63 within which the mortar placed in the joints between such panels will flow. With this construction, it will be recognized that after the mortar placed in the joints sets the keyways will act to interlock adjacent floor panels and transmit therebetween any horizontal shear and stress forces to which the floor structure is subjected. It is to be noted that such keyways are provided not only along the proposed side edges of adjacent panels defining the joint through which the post-tensioning cables 54 are threaded, but also along the end edges above the load bearing walls, such as above the load bearing wall 52.

All of the visible joints and depressions in the floor construction are filled with mortar so that the finished floor will appear to be the same as a floor slab having the dowels 21 extending thereabove along the joints with the load bearing walls. In this connection, the blockouts 57 are filled with mortar, which mortar will partially fill the voids 56 in each panel. All of the post-tensioning cables will thereby be structurally connected to the panels.

Figure 12:
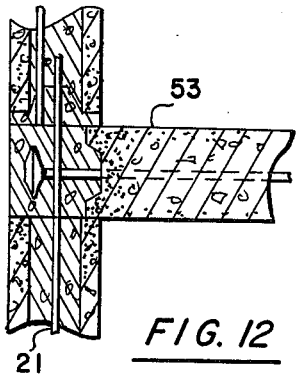
FIG. 12 is another enlarged sectional view illustrating the joint between wall and floor panels at the edge of a completed building.

After the mortar sets, tension is applied to all of the post-tensioning cables, via conventional tensioning anchors at the cable ends as illustrated in FIG. 12. Most desirably, the cables 59 and 61 are tensioned before the parabolic cables 54 and 58. Once the cables have been appropriately tensioned, the access recesses to the tensioning anchors can be filled in with mortar.

It will be recognized that the combination of the post-tensioning arrangement with the mortared keyway joints will result in a floor construction which is completely tied together structurally. Moreover, the load bearing walls will be structurally connected between adjacent floor constructions by reason of the combined mortar joint and overlapped dowel arrangement.

Additional stories of the concrete building can be formed by repeating the procedure. In this connection, FIG. 8 illustrates on top of the floor construction provided by the panels 53 load bearing walls 66 for such an additional construction. Such load bearing walls will be temporarily supported and braced in position, and floor panels for the next succeeding floor construction supported thereon. The construction for such additional story will be tied together in the manner aforesaid.

Most desirably, the floor panels 53 are also precast at the site at which the building is to be erected. Such panels are preferably precast horizontally in basically the same manner as are the wall panels.

As will be recognized from the above, the invention provides a method of constructing buildings having the advantages associated with modular construction while retaining the structural integrity of cast-in-place construction. And while the method has been described in connection with a preferred embodiment thereof in accordance with the dictates of the patent statutes, it will be appreciated by those skilled in the art that various changes can be made without departing from its spirit. It is therefore intended that the coverage afforded applicant be limited only by the scope of the invention as set forth in the claims and their equivalents.

I claim:

1. In a method of forming a concrete building, the steps of erecting a pair of load bearing wall panels generally parallel to and spaced apart from one another; supporting at least two floor panels for a floor construction horizontally adjacent one another on said walls spanning the space therebetween placing a post-tensioning cable for said floor construction along the joint between said adjacent floor panels transverse to said load bearing walls with the portions of said cable over said walls positioned vertically above a portion of said cable positioned over the space between said walls; filling the joint between said adjacent floor panels with mortar; and post-tensioning said cable after said mortar is set.

2. A method according to claim 1 further including the step of providing opposed edges of said floor panels with recessed keyways which when said mortar placed in said joint sets interlocks adjacent floor panels to transmit therebetween horizontal shear and stress forces.

3. A method according to claim 1 further including the step of inserting a post-tensioning cable through said floor panels across said joint between adjacent ones of said panels prior to filling of said joint with mortar; and after said mortar with which said joint is filled sets applying tension to said cable to compress said joint.

4. In a method of forming a concrete building, the steps of:

forming a horizontal base structure with a plurality of spaced apart dowels projecting thereabove along a pair of proposed joints between said structure and a pair of proposed load bearing walls, which joints are generally parallel and spaced apart from one another;

providing a pair of preformed wall panels having voids extending vertically therethrough at a spacing from one another generally the same as the spacing between said dowels at said proposed joints;

placing each of said wall panels respectively along an associated one of said proposed joints with the base structure dowels at said associated joint projecting into an associated wall void;

inserting a reinforcing bar into each of a plurality of said wall voids having a dowel projecting thereinto to a location at which said bar overlaps said dowel;

supporting at least two floor panels for a floor construction on said two wall panels horizontally adjacent one another and spanning the space between said wall panels;

placing a post-tensioning cable for said floor construction along the joint between said adjacent floor panels transverse to said wall panels with the portions of said cable over said wall panels positioned vertically above a portion of said cable positioned over the space between said wall panels; forcing mortar into each of said wall panel voids within which a reinforcing bar overlaps said dowels to tie each of said reinforcing bars to its associated dowel; filling the joint between said adjacent floor panels with mortar; and post-tensioning said cable in said joint after said mortar in said joint is set.

5. A method according to claim 4 of forming a concrete building wherein both said wall panels and said floor panels are made by horizontally precasting the same adjacent the location at which said concrete building is being built.

6. A method according to claim 4 of forming a concrete building further including the step of providing opposed edges of said floor panels with recessed keyways which when said mortar filled in said joint sets interlocks adjacent floor panels to transmit therebetween horizontal shear and stress forces.

7. A method according to claim 4 of forming a concrete building further including the step of inserting a post-tensioning cable through said floor panels across said joint between adjacent ones of said panels prior to filling of said joint with mortar; and after said mortar with which said joint is filled sets, applying tension to said cable to compress said joint.

* * * * *